US008169134B2

(12) United States Patent
Cho et al.

(10) Patent No.: US 8,169,134 B2
(45) Date of Patent: May 1, 2012

(54) FIELD EMISSION DEVICE

(75) Inventors: Hyun-seung Cho, Anyang-si (KR); Hak-cheol Yang, Suwon-si (KR); Jun-ho Sung, Seoul (KR); Ki-bum Seong, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/051,262

(22) Filed: Mar. 18, 2011

(65) Prior Publication Data

US 2011/0234086 A1 Sep. 29, 2011

(30) Foreign Application Priority Data

Mar. 24, 2010 (KR) ..... 10-2010-0026409

(51) Int. Cl.
*H01J 63/04* (2006.01)

(52) U.S. Cl. ..... 313/497; 313/306; 313/336; 313/351; 313/331

(58) Field of Classification Search ..... None
See application file for complete search history.

(56) References Cited

U.S. PATENT DOCUMENTS

2006/0290259 A1* 12/2006 Song et al. ..... 313/495
2007/0259587 A1* 11/2007 Enomoto et al. ..... 445/25

* cited by examiner

*Primary Examiner* — Ashok Patel
(74) *Attorney, Agent, or Firm* — Sughrue Mion, PLLC

(57) ABSTRACT

A field emission device includes: a first substrate on which a gate electrode line, a cathode line, and an electron emission source are formed; a second substrate disposed to face the first substrate, and on which an anode and a phosphor layer are formed; and a side frame surrounding an area between the first substrate and the second substrate, and forming a sealed internal space, wherein the first substrate and the second substrate respectively comprise a first protrusion part and a second protrusion part that protrude outside the side frame in the same direction, wherein a rear terminal part for applying a voltage to the gate electrode line and the cathode line is formed on the first protrusion part, wherein an anode terminal for applying a voltage to the anode is formed on the second protrusion part.

18 Claims, 6 Drawing Sheets

FIELD EMISSION DEVICE

CROSS-REFERENCE TO RELATED PATENT APPLICATION

This application claims the benefit of Korean Patent Application No. 10-2010-0026409, filed on Mar. 24, 2010 in the Korean Intellectual Property Office, the disclosure of which is incorporated herein in its entirety by reference.

BACKGROUND

1. Field

Apparatuses consistent with exemplary embodiments relate to a field emission device, and more particularly, to a field emission device that may be used in a field emission display device, a field emission-type backlight, and the like.

2. Description of the Related Art

Field emission devices (FEDs) emit light in such a way that electrons are emitted from an emitter formed on a cathode by a strong electric field formed around the emitter, and the emitted electrons are accelerated to collide with a phosphor layer formed on an anode.

FEDs may be used as display devices. In particular, a phosphor layer included in a FED is divided into pixel units and materials thereof are determined based on the pixel units so as to emit red, green, and blue lights respectively. In addition, FEDs control the emission of electrons from an emitter according to an image signal, thereby displaying images. Such FEDs may display color images with high resolution and high luminance even at minimum power consumption, and thus are expected to be display devices for the next generation.

In addition, FEDs may be used as backlights of non-emission-type display panels, such as liquid crystal panels. In general, cold cathode fluorescent lamps, which are linear light sources, and light emitting diodes, which are point light sources, have been used as light sources for backlights. However, such backlights generally have complicated structures, and the light sources are disposed at sides of the backlights, thereby consuming a large amount of power due to the reflection and transmission of light. In addition, when liquid crystal panels are manufactured in large sizes, it can be difficult to obtain uniform luminance. On the other hand, when field emission-type backlights are used as backlights, they operate at lower power consumption than backlights using cold cathode fluorescent lamps or light emitting diodes, and may also exhibit relatively uniform luminance even in a wide range of emission areas.

SUMMARY OF THE INVENTION

One or more exemplary embodiments provide a field emission device having a structure in which non-emission areas may be decreased.

According to an aspect of an exemplary embodiment, there is provided a field emission device including: a first substrate on which a gate electrode line, a cathode line, and an electron emission source are formed; a second substrate disposed to face the first substrate, and on which an anode and a phosphor layer are formed; and a side frame surrounding an area between the first substrate and the second substrate, and forming a sealed internal space, wherein the first substrate and the second substrate respectively comprise a first protrusion part and a second protrusion part that protrude outside the side frame in a first direction, wherein a rear terminal part for applying a voltage to the gate electrode line and the cathode line is formed on the first protrusion part, wherein an anode terminal for applying a voltage to the anode is formed on the second protrusion part.

The first protrusion part and the second protrusion part may be disposed such that protruding portions thereof are alternated with respect to each other.

The first protrusion part and the second protrusion part have a shape such that they correspond to engage with each other.

The second protrusion part is formed on a center portion of a side surface of the second substrate, or on at least one end of a side surface of the second substrate.

A longitudinal direction of any one of the gate electrode line and the cathode line may be the first direction, and a longitudinal direction of the other thereof may be a second direction perpendicular to the first direction. In this case, the field emission device may further include, on the first substrate, a routing pattern for guiding any one of the gate electrode line and the cathode line towards the first protrusion.

The phosphor layer may be formed of a phosphor material in which white light is excited by electrons emitted from the electron emission source, or may include a plurality of cell regions formed of phosphor materials in which red light, green light, and blue light are respectively excited by electrons emitted from the electron emission source.

According to an aspect of another exemplary embodiment, there is provided a field emission device including: a first substrate on which a gate electrode line, a cathode line, and an electron emission source are formed; a second substrate facing and spaced apart from the first substrate, and on which an anode and a phosphor layer are formed; and a side frame surrounding an area between the first substrate and the second substrate, and forming a sealed internal space, wherein the first substrate is offset from the second substrate by a predetermined length in a first direction perpendicular to a direction where the first substrate is spaced apart from the second substrate, and a rear terminal part for applying a voltage to the gate electrode line and the cathode line is formed on a protruding region of the first substrate protruding by the predetermined length, wherein an anode terminal for applying a voltage to the anode is formed on at least one corner of the second substrate, disposed relatively corresponding to the protruding region.

The side frame may be in such a form that a cross-section of the sealed internal space has a concave polygon shape having at least one interior angle greater than 180°.

The concave polygon may have a shape such that at least one edge of a rectangle is recessed therein.

A longitudinal direction of any one of the gate electrode line and the cathode line may be the first direction, and a longitudinal direction of the other thereof may be a second direction perpendicular to the first direction. In this case, the field emission device may further include, on the first substrate, a routing pattern for guiding any one of the gate electrode line and the cathode line towards the protruding region of the first substrate, wherein a longitudinal direction of the any one of the gate electrode line and the cathode line is the second direction.

The phosphor layer may be formed of a phosphor material in which white light is excited by electrons emitted from the electron emission source, or may include a plurality of cell regions in which red light, green light, and blue light are respectively excited by electrons emitted from the electron emission source.

BRIEF DESCRIPTION OF THE DRAWINGS

The above and other aspects will become more apparent by describing in detail exemplary embodiments with reference to the attached drawings in which.

DETAILED DESCRIPTION OF EXEMPLARY EMBODIMENTS

Figure 1:
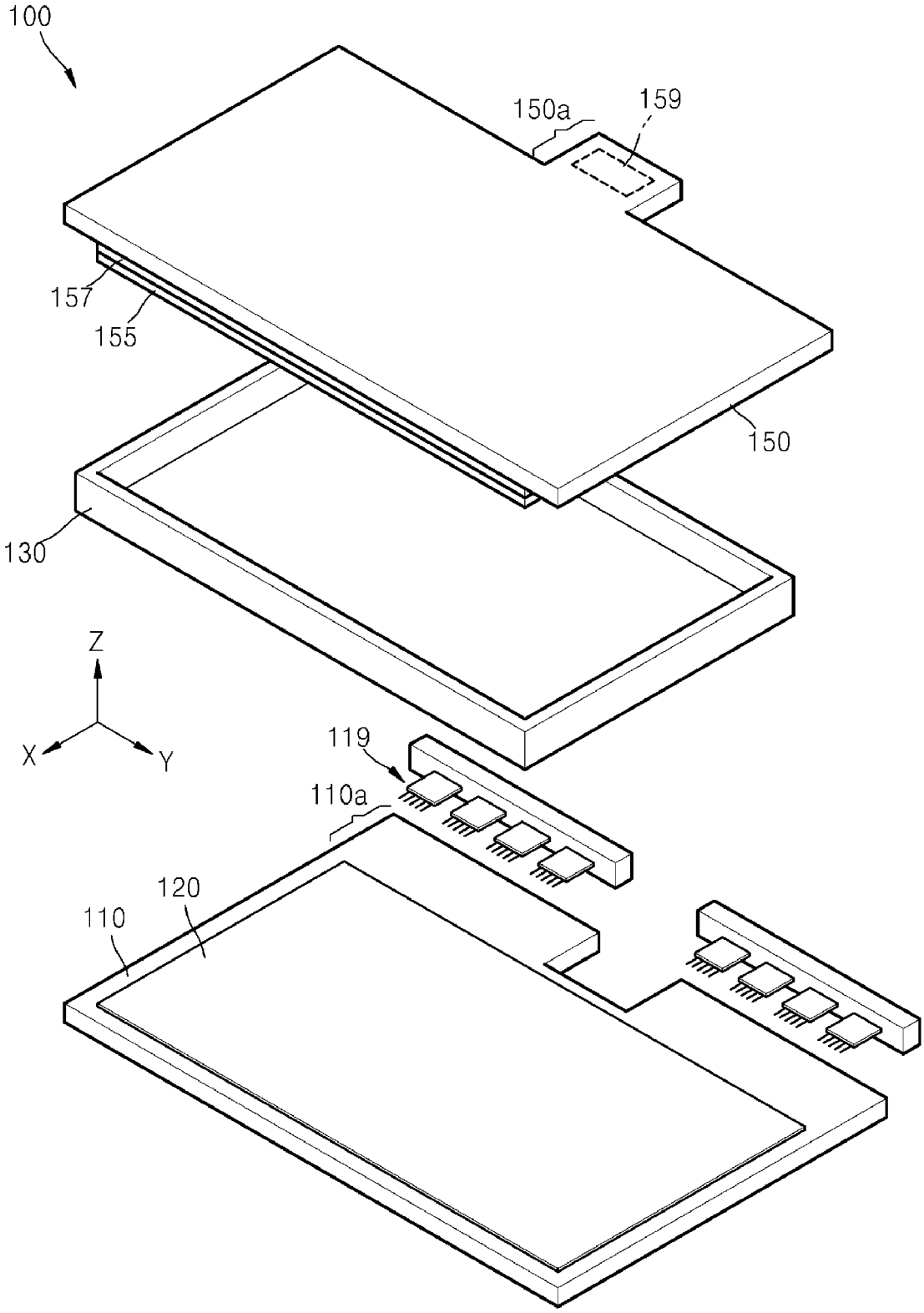
FIG. 1 is a schematic exploded perspective view of a field emission device according to an embodiment.

Exemplary embodiments will now in the accompanying drawings, wherein like reference numerals refer to like elements throughout. In the drawings, the sizes of the elements may be exaggerated for clarity and convenience of explanation.

Figure 2:
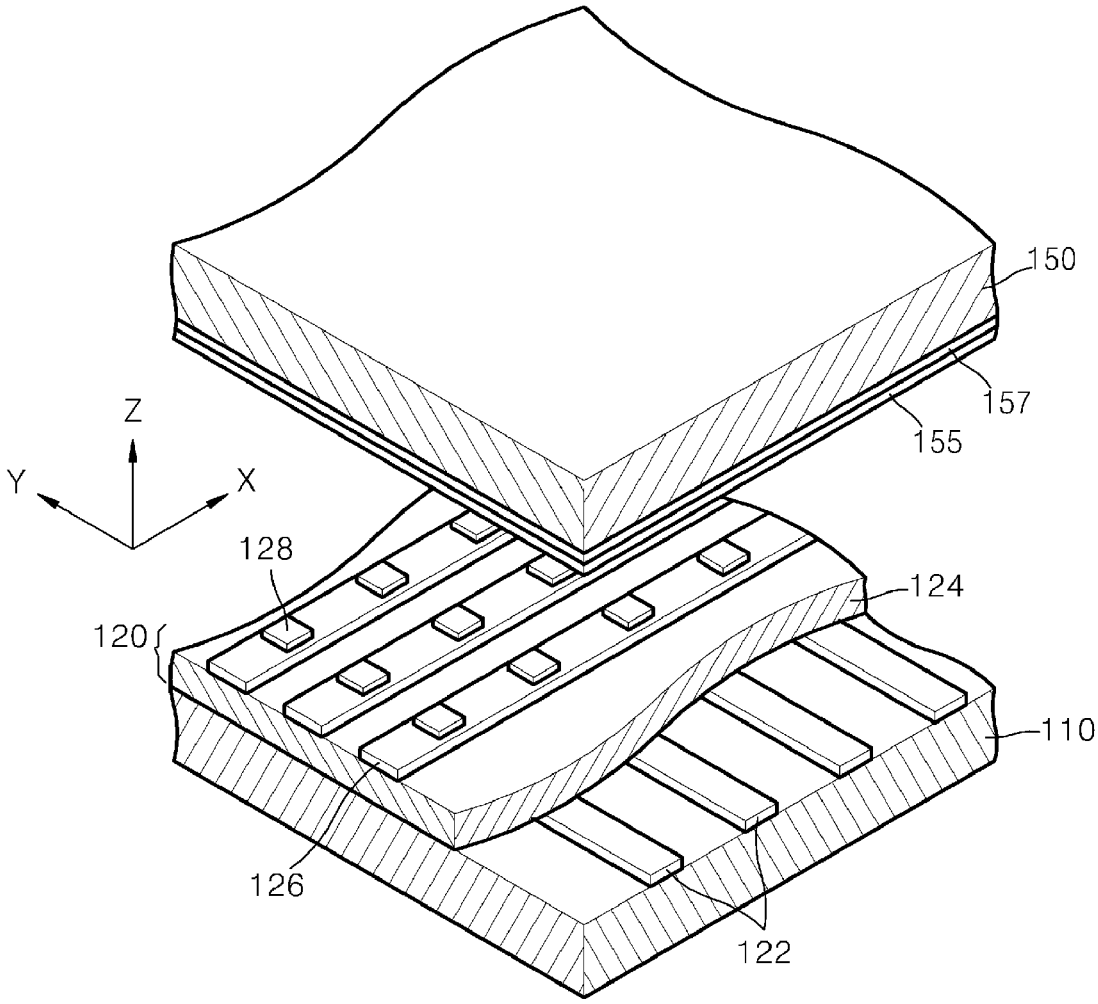
FIG. 2 is a partial perspective view illustrating detailed features of stacked structures formed on first and second substrates of the field emission device of FIG. 1.

FIG. 1 is a schematic exploded perspective view of a field emission device 100 according to an embodiment. FIG. 2 is a partial perspective view illustrating detailed features of stacked structures formed on first and second substrates 110 and 150 of the field emission device 100 of FIG. 1.

Referring to FIG. 1, the field emission device 100 includes the first substrate 110 on which a stacked structure 120 including electron emission sources is formed; the second substrate 150 disposed to face the first substrate 110 and on which an anode 157 and a phosphor layer 155 are sequentially formed; and a side frame 130 that surrounds an area between the first substrate 110 and the second substrate 150 and forms a sealed internal space.

Detailed features of the stacked structure 120 formed on the first substrate 110 and the stacked structures formed on the second substrate 150 and emission performed by the structures will now be described with reference to FIG. 2.

Referring to FIG. 2, a plurality of gate electrode lines 122 are formed on the first substrate 110. An insulating layer 124 is formed on the gate electrode lines 122, and a plurality of cathode lines 126 are formed on the insulating layer 124. A longitudinal direction of the gate electrode lines 122 may be perpendicular to a longitudinal direction of the cathode lines 126. A plurality of electron emission sources 128 are formed on each cathode line 126. In particular, the plurality of electron emission sources 128 may be formed on portions of the cathode line 126 where the gate electrode lines 122 and the cathode line 126 cross over each other. The electron emission sources 128 emit electrons by an electric field formed between the gate electrode lines 122 and the cathode lines 126. The electron emission sources 128 may be formed of carbon nanotubes (CNTs), amorphous carbons, nanodiamonds, nano metal wires, and nano oxide metal wires. The disposition of the gate electrode lines 122, the cathode lines 126, and the electron emission sources 128 is not limited to the embodiment described above, and may be in various forms. For example, the cathode lines 126, the insulating layer 124, and the gate electrode lines 122 may be sequentially formed on the first substrate 110, holes are formed in the gate electrode lines 122 and the insulating layer 124, and the electron emission sources 128 are formed on the cathode lines 126 through the holes.

The anode 157 and the phosphor layer 155 are sequentially formed on the second substrate 150. The second substrate 150 is formed of a transparent material, for example, glass. A high voltage is applied to the anode 157 to accelerate the electrons emitted from the electron emission sources 128. The anode 157 may be formed of a transparent material that allows visible rays to be transmitted therethrough. For example, the anode 157 may be formed of a transparent electrode material, such as indium tin oxide (ITO) or indium zinc oxide (IZO). The phosphor layer 155 may be formed of a phosphor material that emits white light when excited. Alternatively, the phosphor layer 155 may be divided into a plurality of cell regions, and each cell region may be formed of a phosphor material that emits red light, green light, or blue light when excited.

The field emission device 100 may further include a spacer (not shown) disposed between the first substrate 110 and the second substrate 150 so as to maintain a space therebetween.

When a voltage is applied between any one of the plurality of gate electrode lines 122 and any one of the plurality of cathode lines 126, electrons are emitted from the corresponding electron emission source 128 formed on the portion of the cathode line 126 where the gate electrode line 122 and the cathode line 126 to which the voltage is applied cross over each other. The emitted electrons are accelerated by a high voltage that is applied to the anode 157. The accelerated electrons excite the phosphor layer 155 to emit visible rays. A wavelength band of the excited visible rays is determined depending on the material of the phosphor layer 155. When the field emission device 100 is used as a field emission-type backlight, the phosphor layer 155 is formed of a phosphor material that emits white light when excited. When the field emission device 100 is used as a display device, the phosphor layer 150 is divided into a plurality of cell regions corresponding to pixels, and the cell regions each formed of a phosphor material that emit red light, green light, or blue light when excited are alternately disposed with respect to each other.

Referring back to FIG. 1, the first substrate 110 and the second substrate 150 respectively include first protrusion part 110*a* and a second protrusion part 150*a* that protrude outside the side frame 130 in a first direction. The first protrusion part 110*a* and the second protrusion part 150*a* are disposed such that the positions of protruding portions thereof do not overlap with each other and the protruding portions alternate with each other. In addition, the first protrusion part 110*a* and the second protrusion 150*a* may have a shape such that they correspond to engage with each other. In particular, as illustrated in FIG. 1, the second protrusion part 150*a* may be formed on a center portion of a side surface of the second substrate 150, and the first protrusion part 110*a* may be protruded on both sides of a center portion of a side surface of the first substrate 100, wherein the center portion of the side surface of the first substrate 100 corresponds to the center portion of the side surface of the second substrate 150.

A rear terminal part 119 for applying a voltage to the gate electrode lines 122 and the cathode lines 126 is provided on the first protrusion part 110*a*. The rear terminal part 119 provided on the first protrusion part 110*a* is connected to an external printed circuit board (PCB) via a flexible printed circuit (FPC). As illustrated in FIG. 2, a longitudinal direction of any one of the gate electrode line 122 and the cathode line 126 may be the first direction, and a longitudinal direction of the other thereof may be a second direction that is perpendicular to the first direction. In this case, the field emission device 100 may further include a routing pattern on the first substrate 110 so as to guide any one of the gate electrode line 122 and the cathode line 126 towards the first protrusion part 110*a*. A structure of the routing pattern is disclosed in Korean Patent Application No. 10-2010-0025308 filed by the same applicant, and the disclosure thereof can be incorporated herein by reference.

An anode terminal 159 for applying a voltage to the anode 157 is formed on the second protrusion part 150*a*. The anode terminal 159 may be connected to an external high voltage terminal (not shown) via a cable.

As described above, the first substrate 110 and the second substrate 150 respectively include the first protrusion part 110*a* and the second protrusion part 150*a* which protrude from a same side of the field emission device 100, to decrease non-emission areas with respect to a total size of the field emission device 100. In the related art, a gate electrode terminal, a cathode terminal, and an anode terminal respectively protrude from three different side surfaces of a panel. To form such structure, a rear substrate is offset from a front substrate by a predetermined length in two directions that are perpendicular to each other, and protruding regions formed in this manner become non-emission regions. On the other hand, according to an exemplary embodiment, a gate electrode terminal, a cathode terminal, and an anode terminal are disposed on the first protrusion part 110*a* and the second protrusion part 150*a* protruding in the same direction, and thus non-emission regions decrease.

Figure 3:
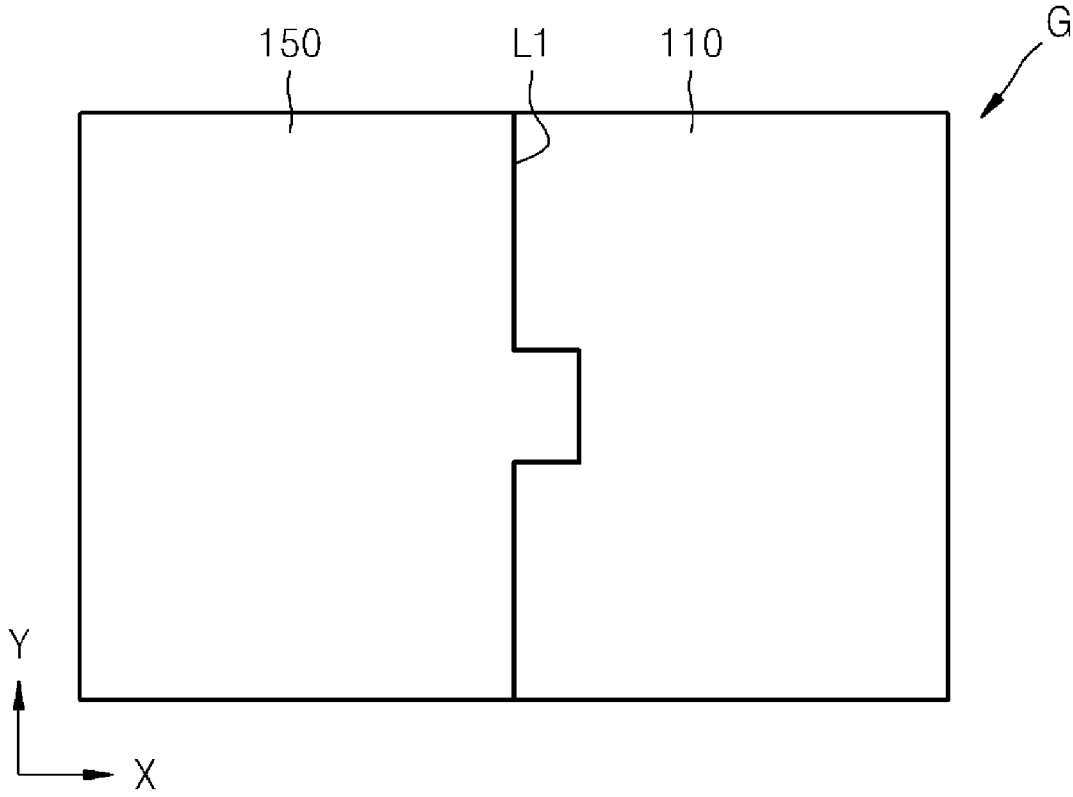
FIG. 3 is a diagram illustrating a method of forming shapes of first and second substrates of the field emission device of FIG. 1, according to an embodiment.

FIG. 3 is a diagram illustrating a method of forming shapes of the first and second substrates 110 and 150 of the field emission device 100 of FIG. 1, according to an embodiment. The first and second substrates 110 and 150 may be formed of a transparent material. For example, a glass substrate G is cut along a cutting line L1 to form the first substrate 110 and the second substrate 150 in the shapes illustrated in FIG. 1.

Figure 4:
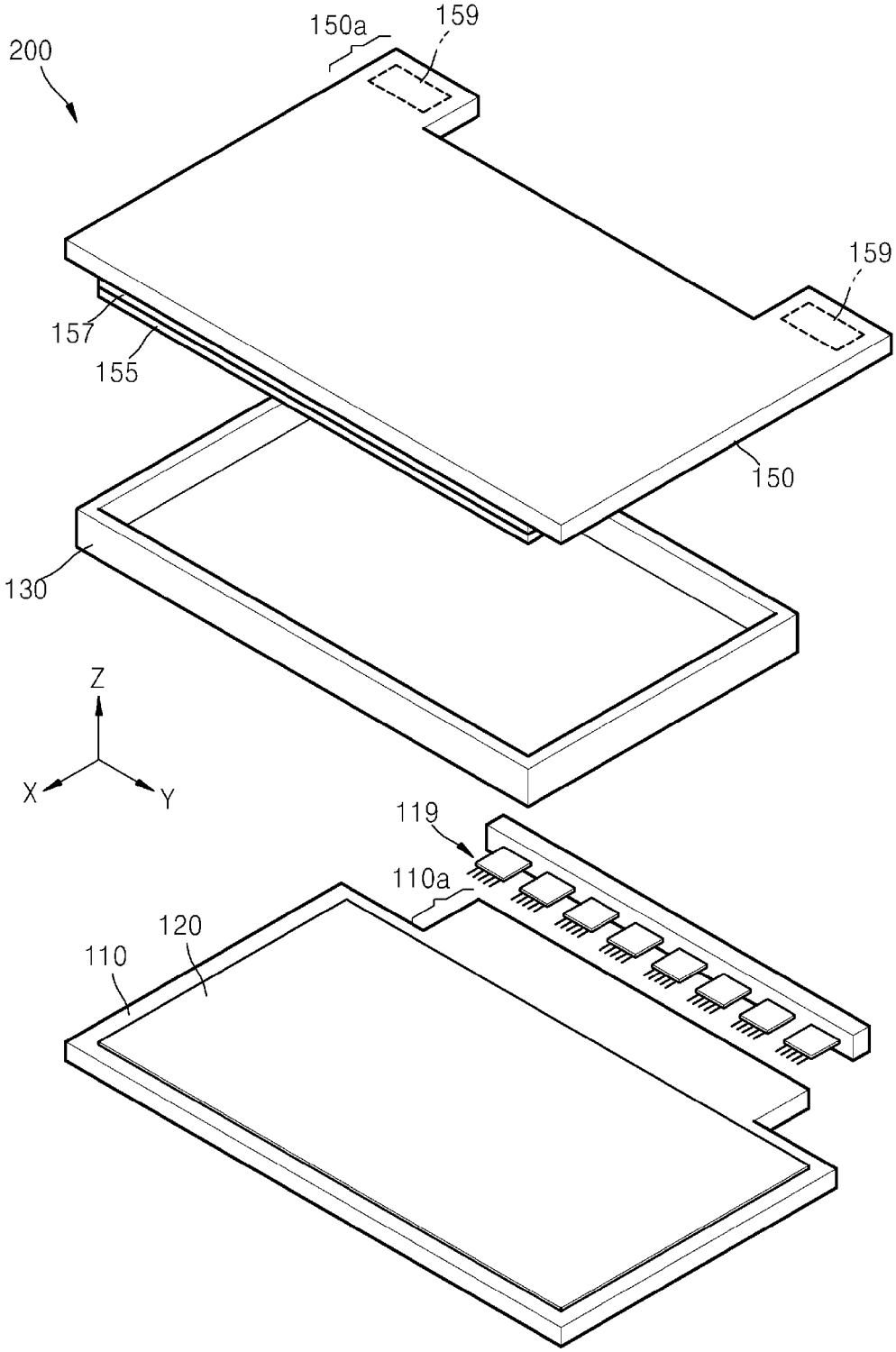
FIG. 4 is a schematic exploded perspective view of a field emission device according to another embodiment.

FIG. 4 is a schematic exploded perspective view of a field emission device 200 according to another embodiment. The shapes of the first protrusion part 110*a* of the first substrate 110 and the second protrusion part 150*a* of the second substrate 150 in the present embodiment are different from those in the embodiment of FIG. 1. The second protrusion part 150*a* is protruded on both sides of a side surface of the second substrate 150, and the first protrusion part 110*a* is formed on a region of a side surface of the first substrate 110, wherein the region of the side surface of the first substrate 110 corresponds to a region on which the second protrusion part 150*a* is not protruded. The anode terminal 159 is formed on the second protrusion part 150*a*, and the rear terminal part 119 is provided on the first protrusion part 110*a*. Although the anode terminal 159 is formed on the two portions of the second protrusion part 150*a* as illustrated in FIG. 4, this is only for illustrative purposes, and the anode terminal 159 may be formed on only any one portion of the second protrusion part 150*a*.

Figure 5:
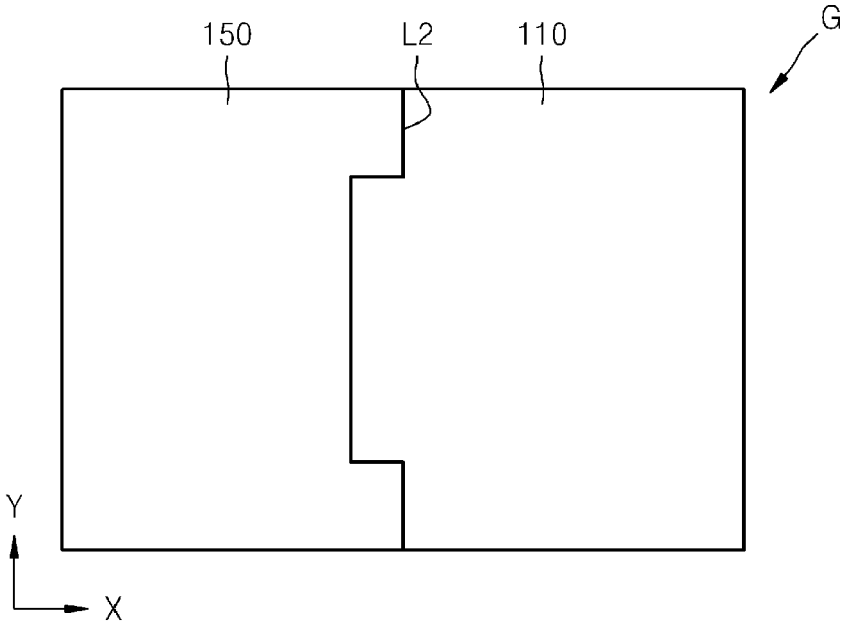
FIG. 5 is a diagram illustrating a method of forming shapes of first and second substrates of the field emission device of FIG. 4, according to an embodiment.

FIG. 5 is a diagram illustrating a method of forming shapes of first and second substrates 110 and 150 of the field emission device 200 of FIG. 4, according to an embodiment. Referring to FIG. 5, the glass substrate G is cut along a cutting line L2, and accordingly, the first substrate 110 and the second substrate 150 are formed in the shapes illustrated in FIG. 4.

Figure 6:
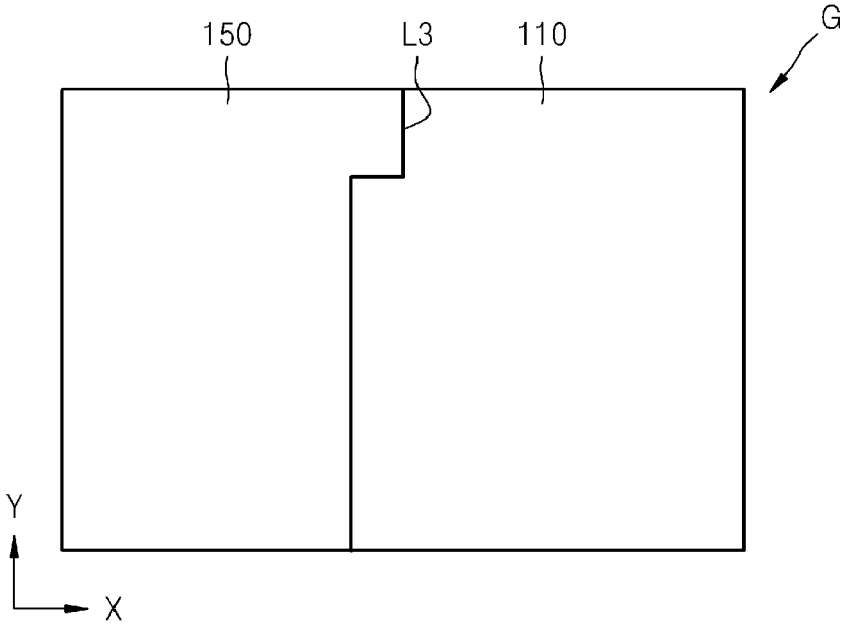
FIG. 6 is a diagram illustrating a method of forming shapes of first and second substrates of the field emission device of FIG. 4, according to another embodiment.

FIG. 6 is a diagram illustrating a method of forming shapes of the first and second substrates 110 and 150 of the field emission device 200 of FIG. 4, according to another embodiment. Referring to FIG. 6, the glass substrate G may be cut along a cutting line L3 so that each of the first substrate 110 and the second substrate 150 includes one protrusion. The protrusion of the first substrate 110 is formed in a relative large size, and the rear terminal part 119 is formed thereon. On the other hand, the protrusion of the second substrate 150 is formed in a relatively small size, and the anode terminal 159 is formed thereon.

As described above, the glass substrate G is cut along a given cutting line to form the first substrate 110 and the second substrate 150, and the first substrate 110 and the second substrate 150 are disposed in such a way that the protrusions of the first and second substrates 110 and 150 alternate with each other and extend in the same direction, thereby easily manufacturing a field emission device including decreased non-emission regions. The shapes of the cutting line are not limited to the embodiments described above, and the cutting line may be formed in various shapes taking into consideration the cuttability of the glass substrate G and the fact that protrusions are formed in a minimized size that allows the rear terminal part 119 and the anode terminal 159 to be formed thereon.

Figure 7:
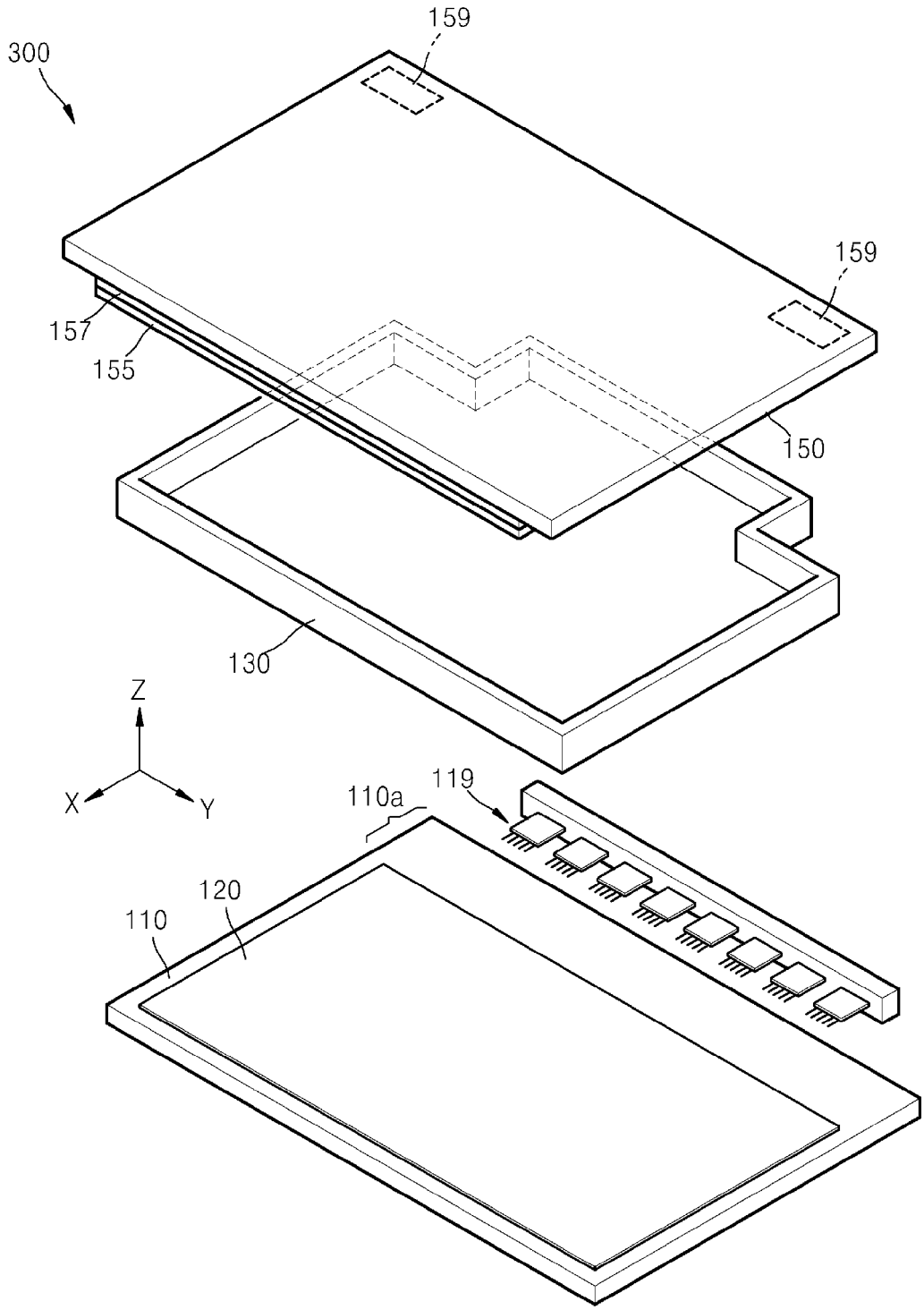
FIG. 7 is a schematic exploded perspective view of a field emission device according to another embodiment.

FIG. 7 is a schematic exploded perspective view of a field emission device 200 according to another embodiment. Referring to FIG. 7, the field emission device 300 includes the first substrate 110 on which the stacked structure 120 including electron emission sources is formed; the second substrate 150 facing and spaced apart from the first substrate 110 and on which the anode 157 and the phosphor layer 155 are sequentially formed; and the side frame 130 that surrounds an area between the first substrate 110 and the second substrate 150, and forms a sealed internal space.

A detailed description of the stacked structure 120 is already provided above, and the stacked structure 120 is not limited thereto.

The first substrate 110 is offset from the second substrate 150 by a predetermined length in a first direction. The first direction is an X-axis direction that is perpendicular to a direction where the first substrate 110 and the second substrate 150 are spaced apart from each other (i.e., Z-axis direction in FIG. 7). Due to such disposition, the rear terminal part 119 for applying a voltage to the gate electrode lines 122 and the cathode lines 126 is provided on the first protrusion part 110*a* protruding by the predetermined length.

In addition, the anode terminal 159 for applying a voltage to the anode 157 is provided on at least one corner region of the second substrate 150 that is disposed relatively corresponding to the first protrusion part 110*a*.

The side frame 130 has a shape in which the anode terminal 159 formed on the at least one corner of the second substrate 150 corresponds to a region outside the side frame 130. For example, the side frame 130 may be in such a form that the cross-section of the internal space formed by the side frame 130 has a concave polygon shape having at least one interior angle greater than 180°. Also, as illustrated in FIG. 7, the side frame 130 may have a rectangular shape including at least one edge recessed therein. Referring to FIG. 7, the anode terminals 159 are respectively formed on two corners of the second substrate 150, and the internal space formed by the side frame 130 has a rectangular cross-section including two edges recessed therein; however, exemplary embodiments are not limited thereto. For example, the anode terminal 159 is formed on one corner of the second substrate 150, and the internal space of the side frame 130 may have a rectangular cross-section having one edge recessed therein.

The shape of the side frame 130 may be easily manufactured using a hot-melt adhesion process, and the first substrate 110 and the second substrate 150 are manufactured in the same shape and offset from each other in a direction, and thus the field emission device 200 with reduced non-emission regions may easily be manufactured.

While exemplary embodiments have been particularly shown and described, it will be understood by those of ordinary skill in the art that various changes in form and details may be made therein without departing from the spirit and scope of the inventive concept as defined by the following claims.

What is claimed is:

1. A field emission device comprising:

a first substrate which comprises a first protrusion, and on which a at least one gate electrode line, at least one cathode line, and at least one electron emission source are formed;

a second substrate which comprises a second protrusion part, and on which an anode and a phosphor layer are formed;

a side frame which is interposed between the first substrate and the second substrate and surrounds an area between the first substrate and the second substrate to form a sealed internal space, wherein the first protrusion part of the first substrate and the second protrusion part of the second substrate protrude outside an outer periphery of the side frame in a first direction;

a rear terminal part through which a voltage is applied to the gate electrode line and the cathode line, and which is formed on the first protrusion part; and an anode terminal through which a voltage is applied to the anode, and which is formed on the second protrusion part.

2. The field emission device of claim 1, wherein the first protrusion part and the second protrusion part are provided at positions that do not overlap each other.

3. The field emission device of claim 2, wherein the first protrusion part and the second protrusion part have shapes such that they correspond to engage with each other.

4. The field emission device of claim 3, wherein the second protrusion part is provided at a center portion of a side surface of the second substrate.

5. The field emission device of claim 3, wherein the second protrusion part is provided at one end or opposite ends of a side surface of the second substrate.

6. The field emission device of claim 1, wherein a longitudinal direction of one of the gate electrode line and the cathode line is the first direction, and a longitudinal direction of the other one of the gate electrode line and the cathode line is a second direction perpendicular to the first direction.

7. The field emission device of claim 6, wherein the first substrate includes a routing pattern for guiding one of the gate electrode line and the cathode line towards the first protrusion part.

8. The field emission device of claim 1, wherein the phosphor layer comprises a phosphor material which emits white light when excited by electrons emitted from the electron emission source.

9. The field emission device of claim 1, wherein the phosphor layer comprises a first cell region comprising a phosphor material which emits red light excited by electrons emitted from the electron emission source, a second cell region comprising a phosphor material which emits green light when excited by electrons emitted from the electron emission source, and a third cell region comprising a phosphor material which emits blue light when excited by electrons emitted from the electron emission source.

10. A field emission device comprising:

a first substrate on which a at least one gate electrode line, at least one cathode line, and at least one electron emission source are formed;

a second substrate on which an anode and a phosphor layer are formed;

a side frame which is interposed between the first substrate and the second substrate, and surrounds an area between the first substrate and the second substrate to form a sealed internal space, wherein the first substrate is offset from the second substrate by a predetermined length in a first direction perpendicular to a direction in which the first substrate is spaced apart from the second substrate by the side frame;

a rear terminal part through which a voltage is applied to the gate electrode line and the cathode line, and which is formed on a protruding region of the first substrate protruding by the predetermined length; and an anode terminal through which a voltage is applied to the anode, and which is formed on at least one corner of the second substrate, corresponding to the protruding region of the first substrate.

11. The field emission device of claim 10, wherein the side frame has a concave polygon shape having at least one interior angle greater than 180°.

12. The field emission device of claim 11, wherein the concave polygon shape is a rectangle having at least one corner which is recessed.

13. The field emission device of claim 10, wherein a longitudinal direction of one of the gate electrode line and the cathode line is the first direction, and a longitudinal direction of the other one of the gate electrode line and the cathode line is a second direction perpendicular to the first direction.

14. The field emission device of claim 13, wherein the first substrate includes a routing pattern for guiding one of the gate electrode line and the cathode line towards the protruding region of the first substrate, and a longitudinal direction of the one of the gate electrode line and the cathode line is the second direction.

15. The field emission device of claim 10, wherein the phosphor layer comprises a phosphor material which emits white light when excited by electrons emitted from the electron emission source.

16. The field emission device of claim 10, wherein the phosphor layer comprises a first cell region comprising a phosphor material which emits red light excited by electrons emitted from the electron emission source, a second cell region comprising a phosphor material which emits green light when excited by electrons emitted from the electron emission source, and a third cell region comprising a phosphor material which emits blue light when excited by electrons emitted from the electron emission source.

17. A field emission device comprising:

a first substrate which comprises a first protrusion part;

a stacked structure which is disposed on the first substrate and comprises at least one gate electrode line, at least one cathode line, and at least one electron emission source;

a second substrate which comprises a second protrusion part;

an anode which is disposed on the second substrate;

a phosphor layer which is disposed on the anode and faces the stacked structure;

a side frame which is interposed between the first substrate and the second substrate and surrounds an area between the first substrate and the second substrate to form a sealed internal space, wherein the first protrusion part of the first substrate and the second protrusion part of the second substrate protrude outside an outer periphery of the side frame in a same direction;

a rear terminal part which disposed on the first protrusion part and connected to the gate electrode line and the cathode line; and an anode terminal which is disposed on the second protrusion part and is connected to the anode.

18. The field emission device of claim 17, wherein the first substrate and the second substrate are disposed so that the first protrusion part and the second protrusion part do not overlap each other.

* * * * *